United States Patent [19]

Pasco

[11] 4,455,792

[45] Jun. 26, 1984

[54] PROCESS FOR ERECTING A BUILDING AND BUILDING ERECTED IN ACCORDANCE THEREWITH

[76] Inventor: Roland Pasco, 46 avenue A. Briand, 50100 - Cherbourg, France

[21] Appl. No.: 233,094

[22] Filed: Feb. 10, 1981

[51] Int. Cl.[3] ..... E04D 13/00

[52] U.S. Cl. ..... 52/90; 52/93; 52/295

[58] Field of Search ..... 52/90, 92, 93, 293, 52/294, 295, 296, 601, 639, 732, 741, 228; 403/162, 262, 256, 358, 355

[56] References Cited

U.S. PATENT DOCUMENTS

| | | | |
|---|---|---|---|
| 1,188,959 | 6/1916 | McAlarney | 52/293 |
| 2,414,628 | 1/1947 | Battin | 52/293 |
| 2,562,483 | 3/1949 | Bender . | |
| 2,943,716 | 12/1955 | Babcock . | |
| 3,969,862 | 7/1976 | Kuss | 52/92 |
| 4,015,399 | 4/1977 | Prins | 52/293 |
| 4,095,381 | 6/1978 | Garchinsky | 52/295 |

FOREIGN PATENT DOCUMENTS

| | | | |
|---|---|---|---|
| 679533 | 4/1965 | Belgium . | |
| 0686378 | 7/1930 | France | 52/584 |
| 1135858 | 5/1957 | France | 52/92 |
| 1251801 | 3/1960 | France . | |
| 1517917 | 2/1967 | France . | |
| 0807543 | 1/1959 | United Kingdom | 52/92 |
| 1339899 | 12/1973 | United Kingdom . | |

*Primary Examiner*—John E. Murtagh

*Attorney, Agent, or Firm*—Fisher, Christen & Sabol

[57] ABSTRACT

A building framework is erected from prefabricated metal elements by securing vertical uprights to a lower belt by means of vertical lugs and positioning keys. An upper belt is likewise secured to the tops of the vertical uprights. The lower belt is formed by U-sections which rest horizontally on one arm so that the opening of the U-section faces the inside of the building. The horizontal top face of the other arm is provided with the lugs. Concrete is poured in the space inside the lower belt thereby forming a shuttering. Trusses having two support plates each adapted to rest on the top of a vertical upright are secured to the uprights by means of lugs and keys. The framework is rapidly assembled without the need for bolting, rivoting, or welding. The monolithic structure however, is stable and resistant to seismic movements.

7 Claims, 8 Drawing Figures

PROCESS FOR ERECTING A BUILDING AND BUILDING ERECTED IN ACCORDANCE THEREWITH

FIELD AND OBJECTS OF THE INVENTION

The present invention relates to a process for erecting a building framework from prefabricated metal elements and to an assembly of prefabricated metal elements for the erection of a building framework in accordance therewith.

It is a first object of the present invention to enable a building framework to be erected from prefabricated metal elements by assembling said elements in situ without bolting or welding operations, the metal elements not requiring high precision in manufacture and subsequent assembly and being adapted to be assembled by non-qualified manpower.

It is a further object of the invention to make a building framework which is easy to dismantle.

Another object of the invention is to make a building framework which is seismic-proof.

A further object of the invention is to make a building framework which is stable and long-lasting, without foundations sunk in the ground, the framework merely resting on the supporting ground.

SUMMARY OF THE INVENTION

The present invention relates to a process for erecting, from prefabricated metal elements, a building framework, with seismic-proof capacity, comprising the steps of:

assembling along the perimeter of the building a continuous lower belt formed by U-sections resting horizontally on one arm so that the opening of said U-section faces the inside of said building; the horizontal top face of the other arm being provided with vertical lugs;

mounting on this belt a succession of vertical uprights, the bottom of each upright being fast with a horizontal base provided with holes adapted to fit on said vertical lugs welded on the top face of the section, securing the uprights to the lower belt by positioning keys cooperating with said vertical lugs, superposing on the succession of vertical uprights an upper belt thus joining the tops of the uprights together, said uprights comprising to this end an upper plate bearing vertical lugs, passing through holes provided on said upper belt;

securing the upper belt on the uprights by positioning keys cooperating with the vertical lugs at the top of the uprights, placing a reinforcing iron frame inside said lower belt and pouring concrete in the space inside said lower belt, forming a shuttering, to obtain an inert monolithic base of the building.

The present invention also relates to an assembly of prefabricated metal elements with seismic-proof capacity for the erection of a building framework, comprising :

a plurality of U-sections adapted to be assembled end to end to form a lower peripheral belt, one arm of the sections comprising locking lugs on its outer face.

a plurality of uprights adapted to be mounted on the lower belt formed by the U-sections, the uprights comprising a horizontal base provided with holes adapted to fit on the lugs of the lower belt, the top of the uprights comprising a horizontal plate bearing lugs.

a plurality of girders adapted to be assembled end to end to form an upper peripheral belt, resting on the top of said uprights and provided with holes adapted to fit on the lugs at the top of said uprights.

a plurality of keys adapted to cooperate with said lugs on the lower belt and at the top of said uprights to lock each of said lugs in the holes receiving it.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
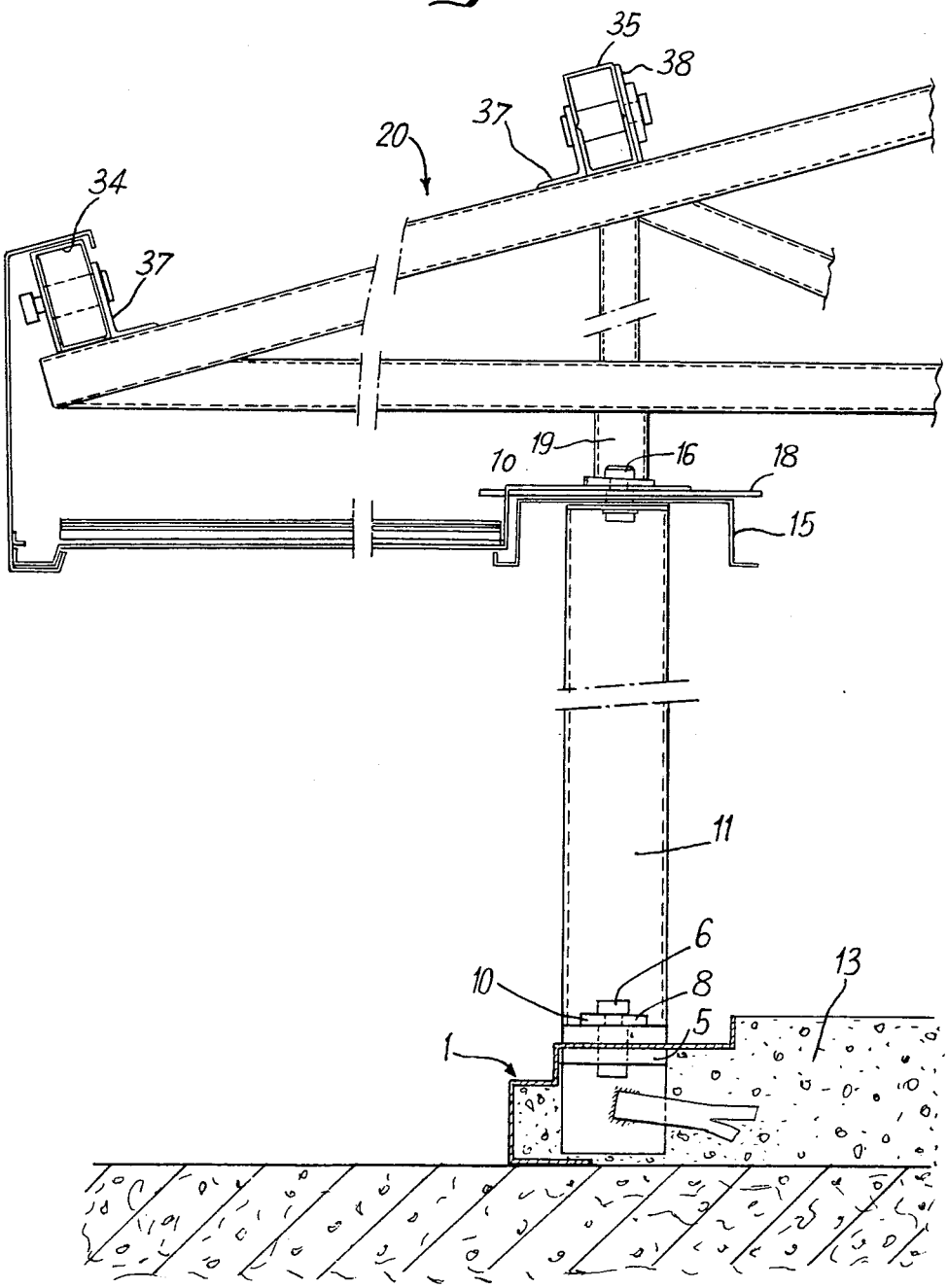
FIG. 1 is a schematic view in section of the framework according to the invention.

Referring now to the drawings, the process according to the invention comprises the positioning of a lower belt 1 formed by sectioned elements assembled by fish plates in known manner.

Figure 2:
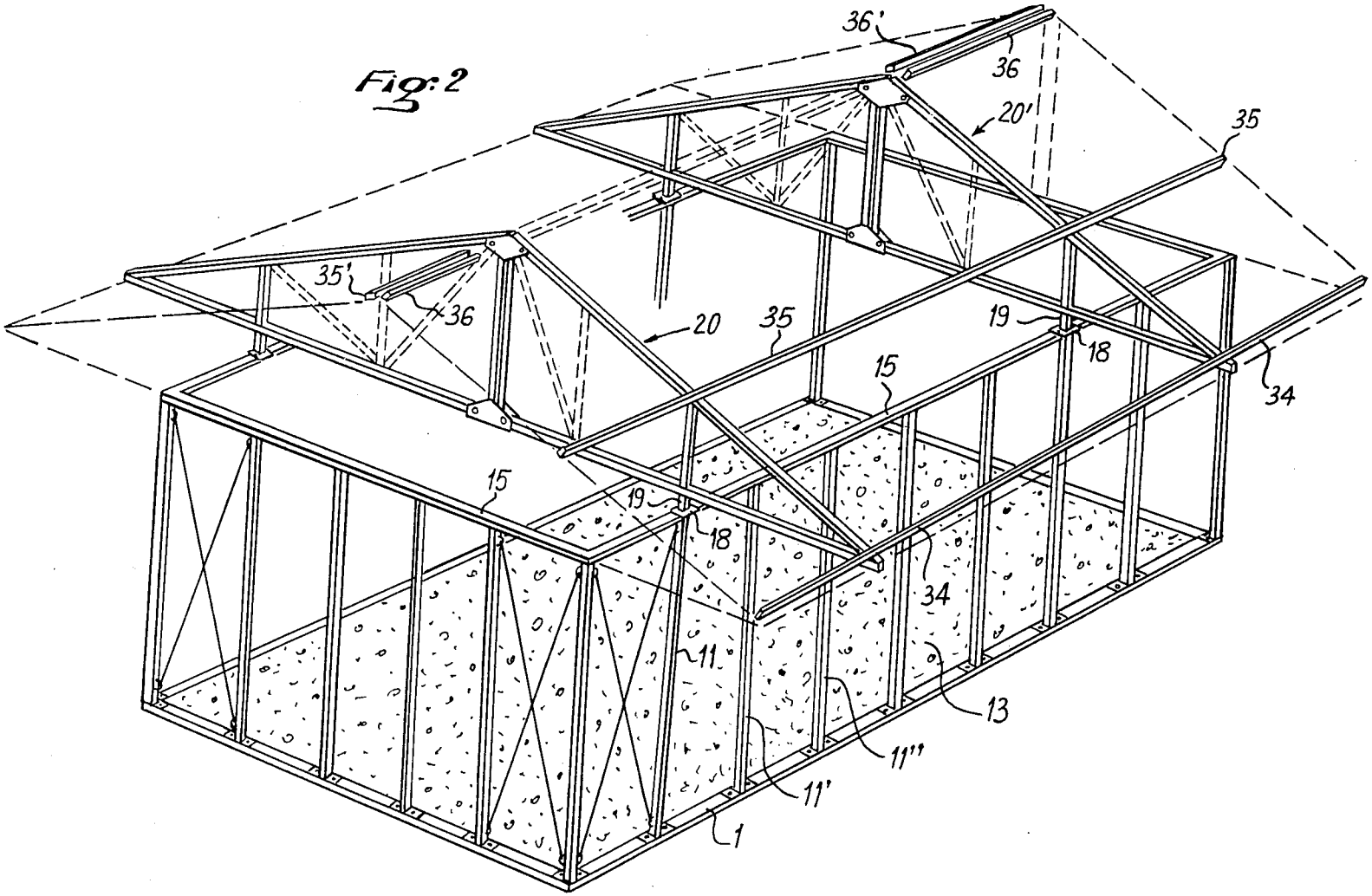
FIG. 2 is a general view in perspective of the building framework in the course of erection.
Figure 3:
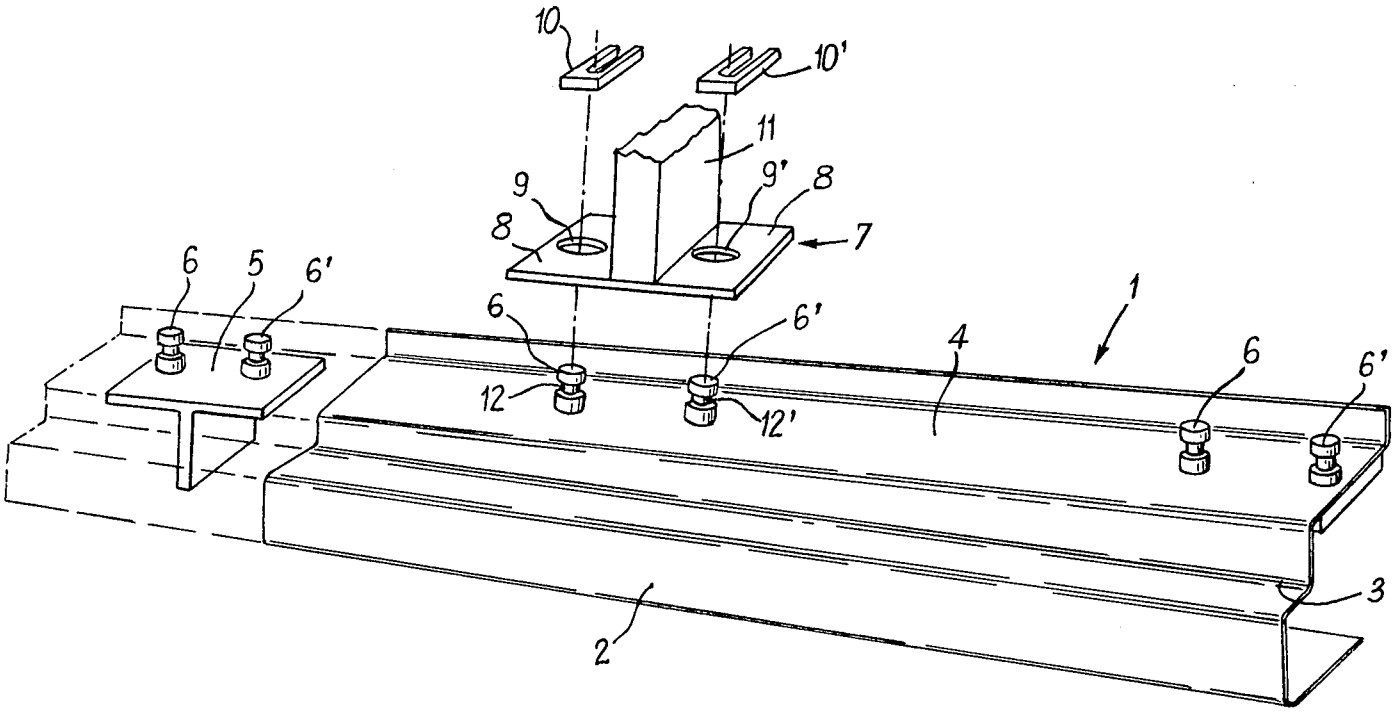
FIG. 3 shows a view in detail of the lower belt for receiving the uprights.
Figure 4:
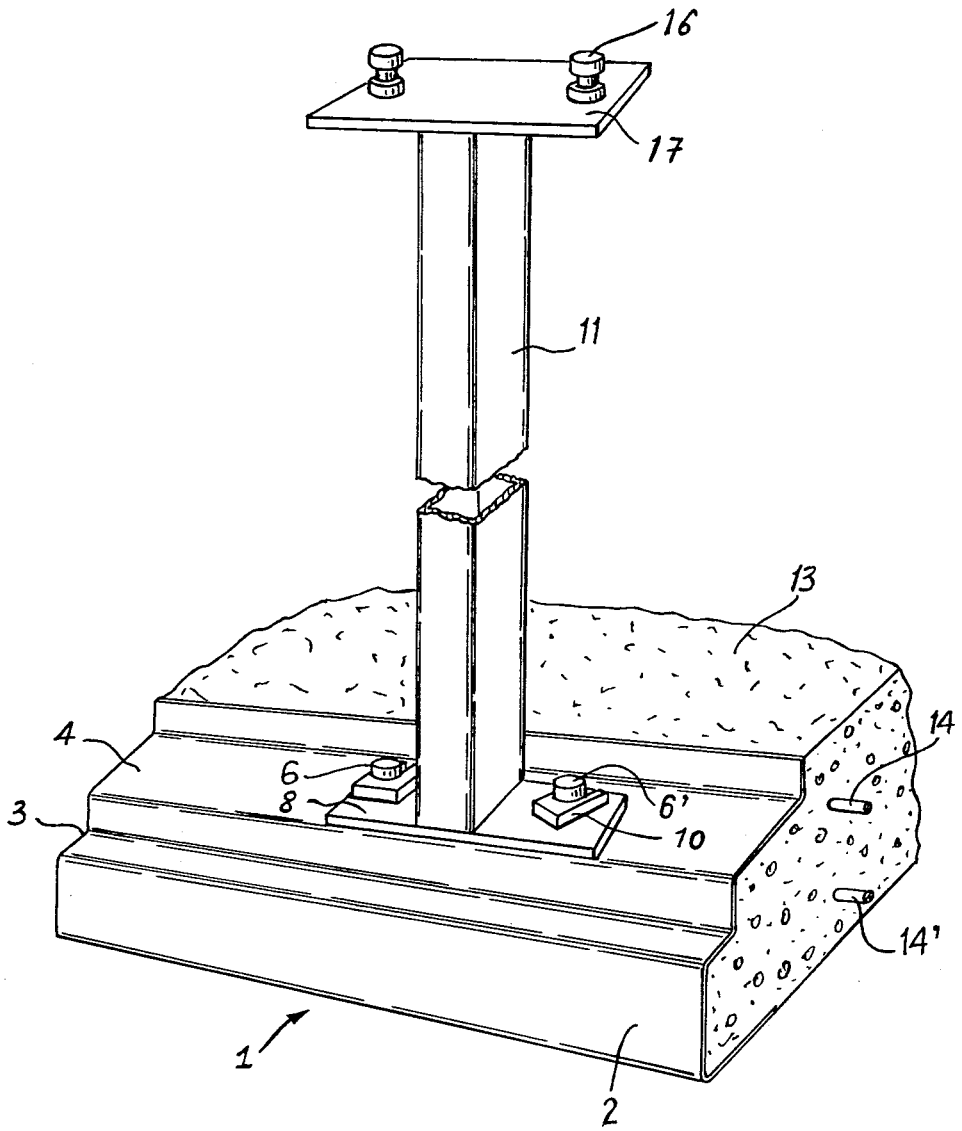
FIG. 4 shows a partial view of vertical uprights mounted on the lower belt.

The lower belt of which a detailed view in perspective is shown in FIGS. 3 and 4, surrounds, after the various longitudinal elements which compose it have been assembled, the whole of the construction as shown in FIG. 2.

In FIG. 3, the lower belt is formed by a U-section whose arms are in horizontal position, the base of the U forming the vertical front wall 2 and the upper arm thereof forming the upper horizontal face 4 of the belt. Between the vertical front wall 2 and the horizontal face 4 is formed a longitudinal recess 3 for reinforcement purposes.

This horizontal face is provided, at regular intervals, with an assembly secured to a lower plate 5.

The plate 5 is constituted by a T-section; it receives, by welding, the vertical assembly lugs 6 and 6', which pass through the wall of the horizontal face 4; the lugs 6 and 6' fast with the horizontal face 4 are adapted to receive the plate 7 forming a double lateral base 8 and 8' respectively, of the upright 11.

The two lateral bases 8 and 8' are pierced with holes 9 and 9', one of which is dimensioned to fit on the lug 6; the other may advantageously be slightly oval so as to allow a certain tolerance; thus the plate 7 may fit on the lugs 6 and 6' to ensure positioning of the upright 11. The assembly is secured by the insertion of keys 10 and 10' in the form of two-pronged forks which are engaged, as shown in FIG. 3, beneath the flanges of the lugs 6 and 6' in the grooves 12 and 12'; to this end, the section of the prongs of the keys decreases towards the ends thereof.

It will be understood that it is very easy and particularly rapid to position the successive uprights at the suitable locations; hammering suffices, in fact, to block the key and immobilize the upright.

The lugs 6 and 6' are disposed at regular intervals along the belt 1 and, as a function of the construction plans, it is a simple and rapid matter to position the uprights where appropriate.

FIG. 2 shows that a peripheral belt may rapidly be positioned in accordance with the construction plan, the uprights 11,11', 11'' etc. . . being very rapidly positioned thereon. . .

According to an advantageous development of the invention, it is a simple matter, as shown in FIG. 4, to pour concrete 13 over a reinforcing frame formed by iron reinforcements 14,14'', inside the belt 1.

A monolithic structure is thus obtained which gives the construction a particularly efficient stability due to its rigidity and inertia; this stability which is independent of the ground on which it rests purely and simply, gives the construction a resistance, particularly to seismic movements.

According to FIG. 1, the tops of the uprights are then assembled by an upper belt 15 which is located immediately above the lower belt 1.

The assembly of the lower belt, the uprights and the upper belt thus constitutes a colonnade which surrounds the periphery of the construction.

Figure 6:
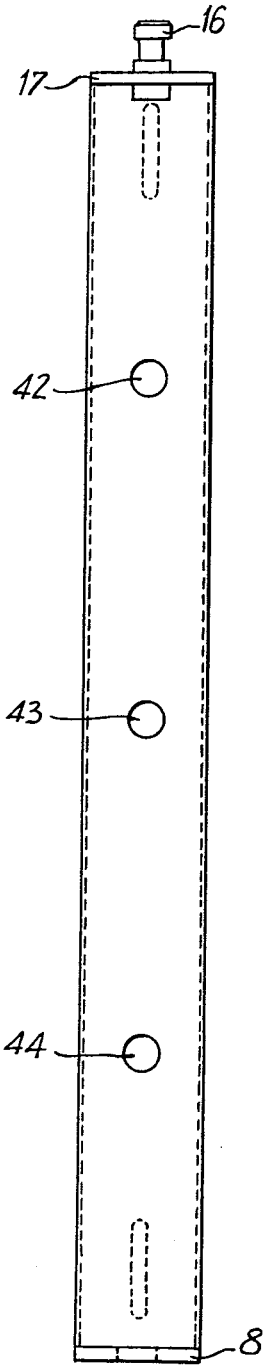
FIG. 6 shows a side elevational view of the upright of FIG. 5.
Figure 5:
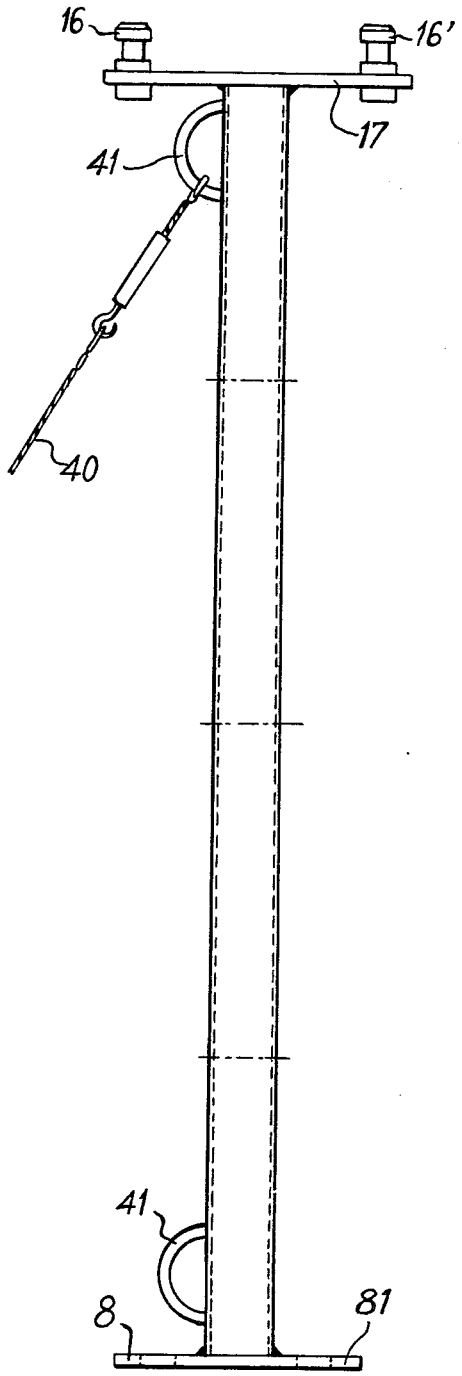
FIG. 5 shows a front elevational view of an upright used within the scope of the invention.

With a view to assembling the upper belt on the uprights, the top end of the latter is provided with a male plate 17 receiving two upwardly facing lugs 16 and 16', as may be seen in FIGS. 5 and 6. Holes provided at regular intervals in the upper belt 15, according to the same module as that adopted for positioning the lugs 6 and 6' of the lower belt.

After the interposition of a counter-plate, a key is positioned, immobilizing the uprights and the upper belt.

Immediately above the trusses, the upper belt 15, of which the holes are fitted on the lugs 16,16' is surmounted by a horizontal support plate 18 fast with a leg 19 supporting the trusses 20 (FIG. 1) and it is the support plate 18 which then acts as counter-plate; the key, identical to keys 10,10' provided at the bottom of the uprights, ensuring blocking by being positioned in the groove beneath the upper flange of the lug 16.

Figure 8:
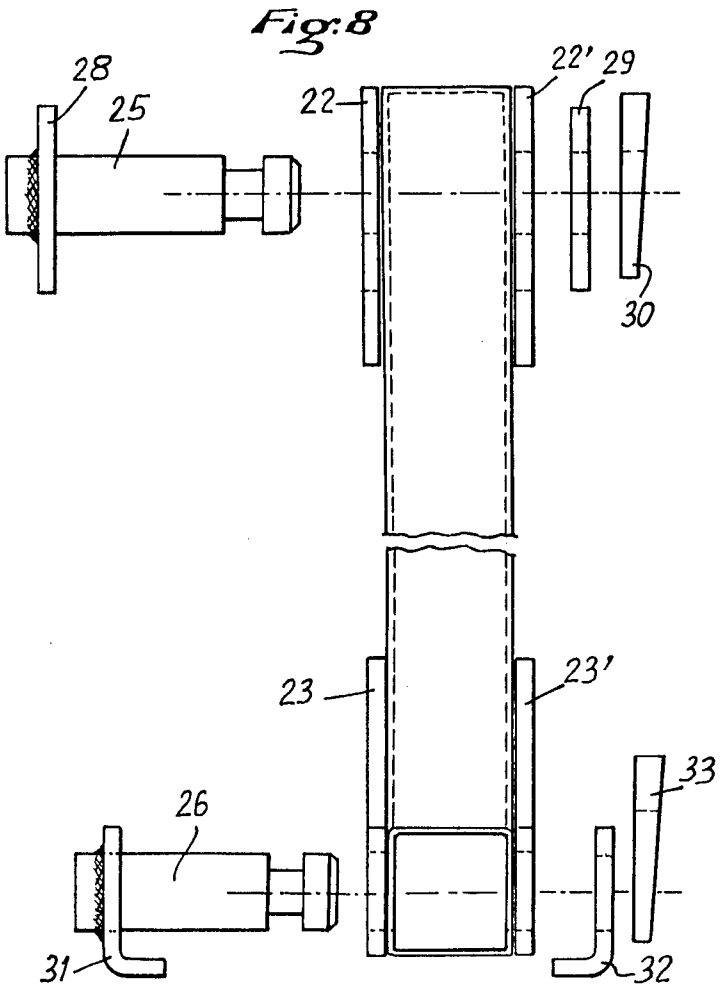
FIG. 8 shows a view in section of the assembly of two half-trusses.
Figure 7:
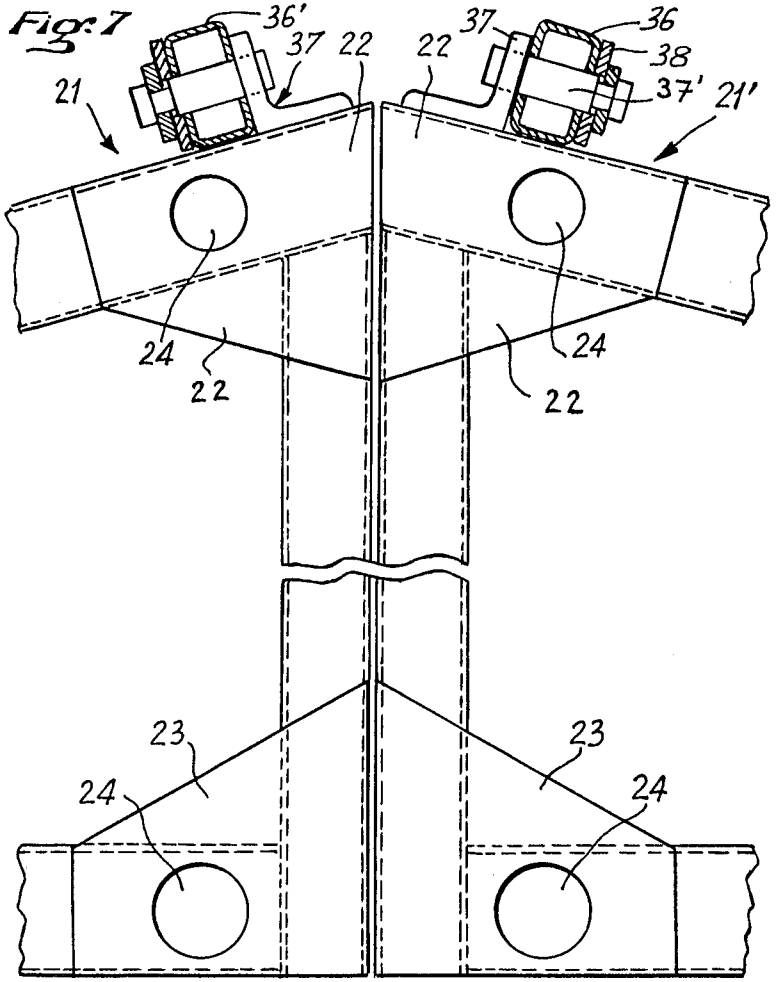
FIG. 7 shows a front elevational view of the assembly of two half-trusses.

As shown in FIGS. 7 and 8, the trusses are constituted by two half-trusses 21 and 21' which may thus be easily transported and are symmetrically joined together at their king post on the construction site.

To this end, the half-trusses comprise, at the top and bottom of the king pin and on each face, reinforcing plates 22,22' (at the top) and 23,23' (at the bottom).

These plates are provided with holes 24 adapted to receive the assembly lugs (25 in ridge position and 26 at tie-beam level) of a gusset plate.

The assembly is obtained by a gusset plate 28 which comprises two twin lugs 25, which are fitted in the holes 24; on the opposite face and after interposition of the counter-plate 29, of which the holes fit on the two lugs 25, the head of the lug 25 is blocked by the positioning of the key 30.

At tie-beam level, a gusset plate 31, similar to plate 28, is used, comprising two lugs 26 which fit in the holes 24 of the two plates 23; on the opposite face, the counter-gusset plate 32 is fitted by its holes on the heads of the lugs 26 and the assembly is blocked by positioning keys 33.

After the trusses have been positioned, they are connected by end purlins 34, intermediate purlins 35 and ridge purlins 36 and 36'.

The purlins are mounted on brackets 37, constituted by corner braces connected by their base to a principal rafter at the suitable spot; the support face of each bracket 37 supports a lug 37' on which holes are fitted which are provided on the respective purlins 34,35,36; after the interposition of a counterplate 38, the assembly is keyed as described previously.

Under these conditions, it is seen that the construction is assembled by simple keying, without resorting to previously used assembly means such as bolting, riveting or welding.

A framework is thus obtained according to the invention which is rapidly placed in position and which may be assembled in a few hours.

As may be seen in FIGS. 5 and 6, the assembly may be wind-braced by stays 40 abutting on half-rings 41 mounted respectively at the top and bottom of the uprights, the stays constituted by steel wire being associated with a tensioning device of known type.

The uprights may also be provided on a side face with openings 42,43,44 for the positioning and connection of door and window frames.

It will be understood that the uprights may be differentiated as a function of the features and plans; reinforced uprights, with respect to standard uprights, may be advantageously used, particularly for angles or for the uprights supporting trusses.

Wind-bracing means may also be provided in the horizontal plane by tensioner, connecting the angles of the building with respect to the trusses.

The assembly thus made may then be decorated according to the architectural plans and as a function of taste, climatic conditions, implantations and local traditions; etc. . .

What is claimed is:

1. A building framework comprising a foundation portion, wall portions and a roof portion;

(a) said foundation portion comprising a plurality of U-sections assembled end to end forming a perimeter for said building; one arm of said U-sections resting horizontally so that the opening of said U-section faces the inside of said building, said other arm of said U-sections being provided with holes; reinforcing T-sections of which the top of said T-section forms a plate provided with vertical lugs having flanged upper portions; said T-section positioned beneath said other arm of said U-section at locations where said holes are positioned in the other arm of the U-section, said lugs of the T-section projecting through said holes in the other arm of the U-section;

(b) said wall portion comprising a plurality of uprights, said uprights having a horizontal base portion provided with holes adapted to fit around said vertical flanged lugs of the T-section, keys cooperating with said vertical flanged lugs for securing said uprights to said T-sections and said U-sections; said top portions of said uprights provided with horizontal plates having vertical flanged lugs welded to the top thereof, an upper belt joining the uprights together and being provided with holes through which said lugs of the horizontal plate project through said holes; and (c) said roof portion comprising trusses with support plates having holes adapted to fit around said vertical lugs of said horizontal plates projecting through the upper belt and through support plates, keys cooperating with said lugs for being driven and locked by hammering said keys around said vertical lugs adjacent said flange.

2. A building framework as in claim 1, wherein said trusses are composed of two half-trusses each half-truss having upper and lower reinforcing plates at a location on said two half-trusses where said half-trusses are to be joined together, said reinforcing plates each having a hole, a gusset plate having welded flanged lugs projecting perpendicularly from said gusset plate, said two half-trusses being joined together by said gusset plate by having the lugs of said gusset plate project through said holes in the reinforcing plates and securing with keys.

3. A building framework of claim 1, further comprising: an angle iron having a lug projecting from one side thereof; end, intermediate, and ridge purlins connected to the trusses by welding of one side of said angle iron on the trusses;

said purlins having corresponding holes adapted to receive said lugs, said lugs being secured with keys.

4. The building of claim 1, wherein said keys are in the form of a planar forked element with two prongs.

5. The building of claim 4, wherein said keys taper in thickness from the closed end to the open end of said forked element.

6. The building of claim 1, wherein said flange of said lugs is formed by a decrease diameter portion and a corresponding increased diameter portion; said keys adapted to only fit around said decreased diameter portion.

7. The building of claim 1, wherein said foundation portion further comprises concrete poured in the space inside the lower belt, forming a shuttering to obtain an inert monolithic base for said building.

* * * * *